US008141732B2

(12) United States Patent
Bohen et al.

(10) Patent No.: US 8,141,732 B2
(45) Date of Patent: Mar. 27, 2012

(54) BOTTLE AND CUP/LID COMBINATION

(75) Inventors: Jeremie F. Bohen, Brussels (BE); Donna B. Baida, London (GB); Paul McLaughlin, Buckinghamshire (GB)

(73) Assignee: The Coca-Cola Company, Atlanta, GA (US)

( * ) Notice: Subject to any disclaimer, the term of this patent is extended or adjusted under 35 U.S.C. 154(b) by 1319 days.

(21) Appl. No.: 11/163,412

(22) Filed: Oct. 18, 2005

(65) Prior Publication Data

US 2007/0084822 A1 Apr. 19, 2007

(51) Int. Cl.
*B65D 51/18* (2006.01)

(52) U.S. Cl. ..... 215/382; 215/381; 215/384; 220/4.27; 220/254.1; 220/254.3; 220/703; 220/711; 220/712

(58) Field of Classification Search ..... 215/381, 215/382, 384; 220/254.1, 254.3, 703, 711, 220/712

See application file for complete search history.

(56) References Cited

U.S. PATENT DOCUMENTS

| | | | | |
|---|---|---|---|---|
| 1,545,353 | A | 7/1925 | Rosell et al. | |
| 1,744,328 | A | 1/1930 | Morley | |
| 2,338,397 | A | 1/1944 | Beasley | 229/4.5 |
| 3,029,963 | A | 4/1962 | Evers | |
| 3,198,375 | A * | 8/1965 | Hunter | 222/566 |
| 3,263,847 | A | 8/1966 | Amann | |
| 3,292,811 | A | 12/1966 | Lynch | 220/4 |
| 3,405,862 | A | 10/1968 | Spyra | 229/5.6 |
| 3,800,843 | A | 4/1974 | Edwards | 150/0.5 |
| 3,970,206 | A | 7/1976 | Morash | 215/11 R |
| 4,854,458 | A | 8/1989 | Differ | |
| 4,883,188 | A | 11/1989 | Barth | 215/12.1 |
| 5,197,624 | A * | 3/1993 | Dodaro | 220/254.3 |
| 5,433,337 | A * | 7/1995 | Willbrandt | 220/669 |
| 5,464,112 | A * | 11/1995 | Guillot | 215/254 |
| 6,082,575 | A | 7/2000 | Skoskiewicz et al. | 220/711 |
| 6,152,318 | A * | 11/2000 | Walker | 220/379 |
| 6,536,622 | B1 | 3/2003 | Planet | 220/269 |
| 6,688,487 | B2 * | 2/2004 | Oakes et al. | 220/788 |
| 2005/0109780 | A1 * | 5/2005 | Pendergrass et al. | 220/254.1 |
| 2005/0178689 | A1 * | 8/2005 | Aardema et al. | 206/521 |

FOREIGN PATENT DOCUMENTS

| | | | |
|---|---|---|---|
| BE | 568178 | | 6/1958 |
| DE | 1822023 | U | 11/1960 |
| DE | 3902570 | A1 | 8/1990 |
| EP | 0755866 | A1 | 1/1997 |
| EP | 1447334 | A1 | 2/2003 |
| EP | 1645518 | A2 | 9/2005 |
| FR | 2543917 | A1 | 4/1983 |
| FR | 2631936 | A1 | 3/1988 |
| FR | 2646071 | A1 | 4/1989 |
| FR | 2673914 | A1 | 3/1991 |
| FR | 2684072 | A1 | 5/1993 |
| JP | 5085534 | | 4/1993 |
| WO | 9956454 | A2 | 11/1999 |
| WO | 03020440 | A1 | 3/2003 |
| WO | 2006045121 | A1 | 4/2006 |

* cited by examiner

*Primary Examiner* — Anthony Stashick
*Assistant Examiner* — Elizabeth Volz
(74) *Attorney, Agent, or Firm* — Sutherland Asbill & Brennan LLP

(57) ABSTRACT

A bottle. The bottle may include a cup with a number of first conical sections, a lid with a number of second conical sections, and a closure positioned on the lid. The upper conical sections mate with the lower conical sections.

10 Claims, 6 Drawing Sheets

BOTTLE AND CUP/LID COMBINATION

TECHNICAL FIELD

The present invention relates generally to beverage containers and, more particularly, relates to a bottle having a sealable cup and lid combination.

BACKGROUND OF THE INVENTION

Restaurants, convenient stores, and other types of retail outlets have long offered beverages from fountain dispensers. Typically, the outlet keeps a supply of cups, lids, and drinking straws on hand. As is well known, the outlet generally fills the cup with ice, fills with the cup with the beverage from the fountain dispenser, places the lid on the cup, and provides the cup and the straw to the consumer. The cups typically are made out of paper with a plastic lid.

Although these known cups are adequate, the consumer also has a desire to see within the cup so as to determine how much of the beverage is remaining. Such is not possible with the current paper cups.

Although plastic containers are clear and well known, such containers generally are not used at restaurants because consumers also would request a separate cup and ice. Rather, plastic bottles are usually filled at a bottling plant and shipped to a retail outlet. The bottle then may sit on a shelf at the outlet or at the consumer's home. The nature of the plastic material will allow a beverage, such as a carbonated soft drink, to remain at the desired carbonation level for weeks or more. Such plastic bottles generally are not filled at a restaurant and then given to a consumer for immediate consumption. Conversely, although paper cups may be filled for immediate consumption, the paper cups have limited portability.

There also is a desire for a cup and lid combination that is made of the same material. Preferably, the material may be recyclable. The combination also may provide adequate sealing such that the combination would be portable by the consumer. Further, the combination preferably will be easy to manufacture, easy to store, easy to fill, easy to transport, easy to use, and be reasonably priced as compared to conventional paper or plastic alternatives.

SUMMARY OF THE INVENTION

The present application thus describes a bottle. The bottle may include a cup with a number of first conical sections, a lid with a number of second conical sections, and a closure positioned on the lid. The upper conical sections mate with the lower conical sections.

The bottle may include a polylactide acid material. The first conical sections may include a first upper section with a first ledge extending therefrom. The second conical sections may include a second upper section with a second ledge extending therefrom. The first ledge may engage the second ledge. The first conical sections may include a first lower section, the second conical sections may include a second lower section, and the first lower section accommodates the second lower section. The closure may include a flip top closure or a number of slits positioned therein. The lid may have a number of buttons positioned thereon. The bottle may be made from a substantially clear material.

The present application further describes a method of providing a beverage. The method may include filling a cup with the beverage, placing a lid with a closure on the cup so as to form a substantially watertight seal, and placing a drinking straw through the closure.

The step of placing the lid may include a two-click interface. The method further may include the steps of providing a number of cups and a number of lids in a nesting relationship. The cup and the lid may be made by stretch blow molding.

The present application further describes a bottle. The bottle may include a mouth, a shoulder, an upper mating section, a middle section, a lower mating section sized so as to mate with the upper mating section when the middle section is removed, a sidewall, and a bottom.

The bottle further may include a polylactide acid material. The shoulder may include a number of ribs. The sidewall may include a number of ribs. The upper mating section may include a first upper section with a first ledge extending therefrom, the lower mating section may include a second upper section with a second ledge extending therefrom, and the first ledge may engage the second ledge when the middle section is removed.

The bottle further may include a closure positioned about the mouth. The closure may include a flip top closure or a number of slits positioned therein. The shoulder may have a number of buttons positioned thereon. The bottle may be made from a substantially clear material.

The present application further describes a method of manufacturing a multi-piece bottle. The method may include the steps of stretch blow molding a thermoplastic material into a bottle with an upper section, a middle section, and a lower section, removing the middle section, and mating the upper section with the lower section. The method further may include the step of placing a closure on the upper section. The thermoplastic material may be a PET (polyethylene terephthalete) material or a PLA (polylactide acid) material.

These and other features of the present application will become apparent to one of ordinary skill in the art upon review of the following detailed disclosure when taken in conjunction with the drawings and the appended claims.

DETAILED DESCRIPTION

Figure 1:
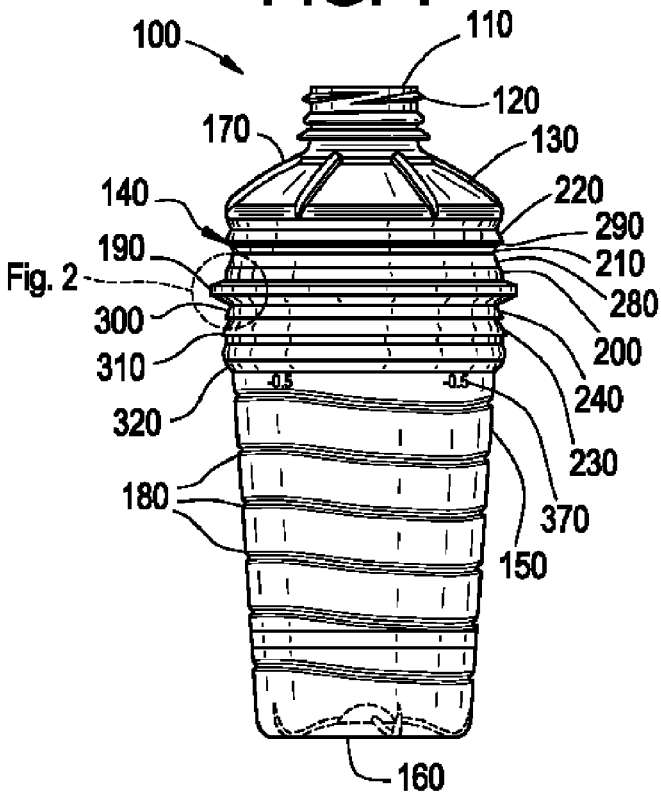
FIG. 1 is a plan view of a bottle as is described herein.

Referring now to the drawings, in which like numerals refer to like elements throughout the several views, FIG. 1 show a bottle 100 as is described herein. The bottle 100 may be made out of a conventional thermoplastic, such as PET (polyethylene terephthalete), PLA (polylactide acid), PP (polypropylene), or similar types of materials. The bottle 100 may be manufactured by blow molding (which may include injection stretch blow molding (one or two steps or otherwise) and extrusion blow molding), or similar types of forming techniques. Preferably, the bottle 100 may be made from a blow molded PLA material. The use of the PLA material requires significantly less fossil fuel as compared to petroleum based plastics and also provides biodegradability. Other types of materials may be used herein. The material may be substantially clear or translucent. By substantially clear or translucent we mean that the consumer can view the contents of the bottle. Colored clear or translucent materials also may be used herein.

From top to bottom, the bottle 100 may include a mouth 110 with threads 120 thereon, a shoulder section 130, a mating section 140, a sidewall 150, and a bottom end 160. The mouth 110 and threads 120 may be of conventional design and may be sized to mate with a conventional closure. Alternatively, the mouth 110 may be threadless so as to accommodate a snap-on closure. The shoulder section 130 may include a number of ribs 170. The ribs 170 may provide rigidity and allow to minimize the amount of material use and/or may be for aesthetic purposes. Any type or number of the ribs 170 may be used herein. The ribs 170 may have any desired shape. The sidewall 150 also may have a number of side ribs 180 formed therein. The side ribs 180 may provide rigidity and allow to minimize the amount of material use and/or may be for aesthetic purposes. Any type or number of the side ribs 180 may be used herein. The side ribs 180 may have any desired shape. The bottom end 170 may include a conventional inverted star design or similar types of base designs.

Figure 2:
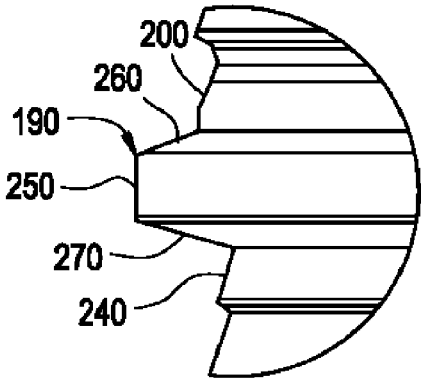
FIG. 2 shows the middle lip of the bottle of FIG. 1.

The mating section 140 may include a number of sections, including a middle lip 190, a first upper section 200, a second upper section 210, a third upper section 220, a first lower section 230, and a second lower section 240. Any number of sections, or other structures, may be used herein. As is shown, the middle lip 190 has an extended sidewall 250 that extends beyond the diameter of the upper sections 220, 210, 220 and the lower sections 230, 240. As is shown in FIG. 2, the middle lip 190 may have the largely vertical sidewall 250 connected to the first upper section 200 via a first angled wall 260 and connected to the second lower section 240 via a second angled wall 270. The middle lip 190 may take any convenient size or shape.

The first upper section 200 may have a slightly curved frusto-conical shape beginning from the first angled wall 260 of the middle lip 190. Other shapes may be used herein. The second upper section 210 also has a substantially frusto-conical shape with a bottom ledge 280 having a diameter greater than the top of the first upper section 200. The second upper section 210 may have a height that is greater than the first upper section 200. Other shapes may be used herein. The third upper section 220 also may have a substantial frusto-conical shape with a ledge 290 that has a diameter greater than the upper portion of the second upper section 210 but less than the ledge 280 of the second upper section 210. The third upper section 220 may have a height that is less than the first upper section 200 or the second upper section 210. Other shapes may be used herein.

The second lower section 240 may be positioned under the middle lip 190 and may be in contact with the second angled wall 270 of the middle lip 190. The second lower section 240 also may have a substantial frusto-conical shape with the area of lesser diameter adjacent to the middle lip 190 and a base in form of a ledge 300 opposite the middle lip 190. Other shapes may be used herein. The first lower section 230 may be positioned under the second lower section 240. The first lower section 230 also may be of a general frusto-conical shape and have a ledge 310 at its base. The first lower section 230 may have a height greater than the second lower section 240. The ledge 310 of the first lower section 230 may have a diameter greater than the ledge 300 of the second lower section 240. Other shapes may be used herein. The first lower section 230 may be shaped and size to accommodate the second upper section 210. The second lower section 240 may be shaped and sized to accommodate the third upper section 220 so as to form a substantial water-tight seal as will be described in more detail below. Other sizes and shapes may be used herein.

The mating section 140 also may have a further lower section 320. The further lower section 320 may be positioned between the first lower section 230 and the sidewall 250. The further lower section 320 may have a somewhat rounded shape and an increased diameter as compared to the sections described above so as to prevent the first upper section 200 from being pushed over the further lower section 320. Other sizes and shapes may be used herein.

In use, the bottle 100 could be used in a conventional fashion, i.e., filled with a beverage and enclosed by a closure of some sort. In this case, the mating section 140 proves largely an ornamental or aesthetic function.

Figure 3:
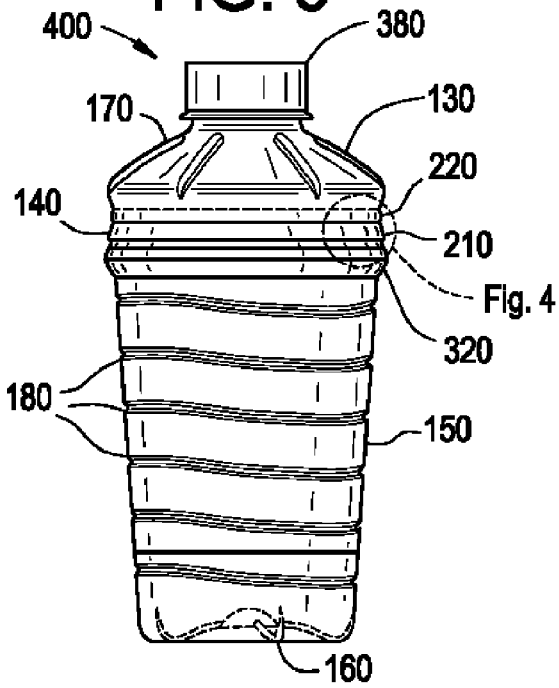
FIG. 3 is a plan view of the cup and lid combination as is described herein.
Figure 4:
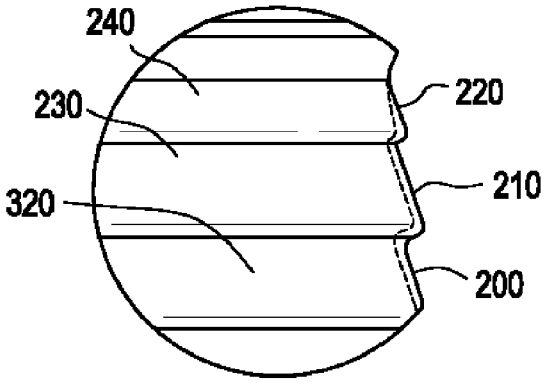
FIG. 4 shows the interface between the cup and the lid.

The bottle 100 also may be cut into three (3) separate elements: a lid 350, the middle lip 190, and a cup 360. The lid 350 would be formed by cutting at the intersection of the first angled wall 260 of the middle lip 190 and the first upper section 200. The cup 360 would be formed by cutting at the intersection of the second angled wall 270 of the middle lip 190 and the second lower section 240. The middle lip 190 then may be discarded. As shown in FIGS. 3 and 4, the lid 350 may be placed on the cup 360 and sealed along the intersection of the first upper section 200 and the first lower section 230 and the second upper section 210 and the second lower section 240 of the mating section 140. The lid 350 may be male or female and the cup 360 may be the opposite.

Figure 5A:
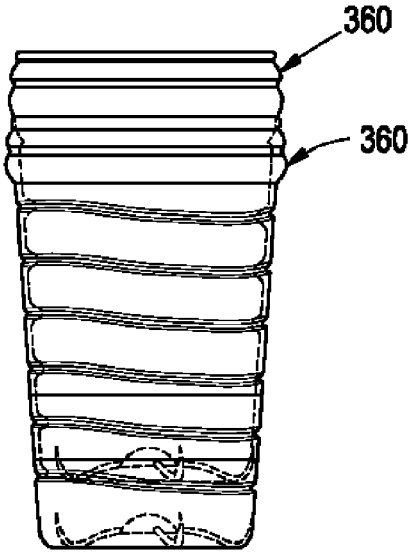
FIG. 5A is a plan view of a stack of cups.
Figure 5B:
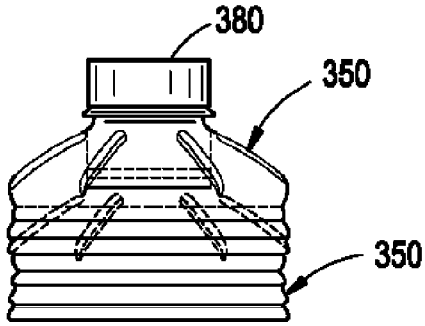
FIG. 5B is a plan view of a stack of lids.

As is shown in FIGS. 5A and 5B, a number of the lids 350 and the cups 360 may be stacked in a nesting relationship with the further lower section 320 of a top cup 360 adjoining the third upper section 220 of a bottom cup 360. Likewise, the lids 350 may be stacked and supported along their respective mouths 110. Any number of lids 350 and cups 360 may be stacked. The lids 350 also may be stacked with closures attached.

An individual cup 360 may be removed from a stack of the cups 360 and filled with ice and a beverage as is desired. As shown in FIG. 1, the cup 360 may include an indicator 370 thereon showing the pour line for a particular sized beverage, such as a half-liter beverage. The indicator 370 may be formed on the sidewall 150 or placed on a label or otherwise. Once the cup 360 is filled to the indicator 370 or otherwise, a lid 350 may be removed from a stack of the lids 350 and placed on the cup 360. As described above, the second upper section 210 mates with the first lower section 230 and the third upper section 220 mates with the second lower section 240 in a "two click" interface. This interface provides a largely watertight seal while allowing ease of application and, if desired, ease of removal of the lid 350 from the cup 360.

The mouth 310 of the lid 350 then may be enclosed with a conventional closure 380 to form a sealed cup-lid combination 400. (The closure 380 also may be applied before the lid 350 is attached to the cup 360. The closure 380 may be applied at any convenient time.) Once the closure 380 is applied, the resultant cup-lid combination 400 can be turned in any orientation without leakage if a non-carbonated beverage is used. The combination 400 may leak somewhat about the closure 380 if a carbonated beverage is used as the closure 380 may vent the pressurized gases somewhat. The combination 400 also can be squeezed to a certain extent without losing the interface between the lid 350 and the cup 360. In fact, the combination 400 can be squeezed with the closure 380 removed and the closure 380 then may be applied so as to create a partial vacuum. Even in this situation, the combination 400 should hold the beverage therein largely without leaking. In the case of a carbonated beverage, the combination 400 also largely maintains the carbonation level of the beverage therein while the closure 380 is applied.

Once the combination 400 is filled and capped, the combination 400 may be given to the consumer. The consumer thus has the opportunity to receive a beverage, such as a carbonated soft drink, straight from the dispensing fountain and packaged in a plastic container for immediate consumption and/or for improved portability. The combination 400 thus is in contrast to existing paper containers filled from a dispensing fountain and existing plastic containers filled at a bottling plant and shipped to a consumer. The combination 400 thus provides an improved container that avoids the current issues with know paper or plastic containers.

Figure 6C:
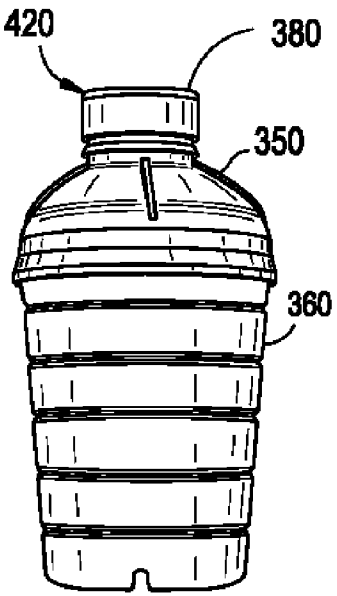
FIGS. 6A-C are perspective views of differently sized cup and lid combinations.
Figure 6B:
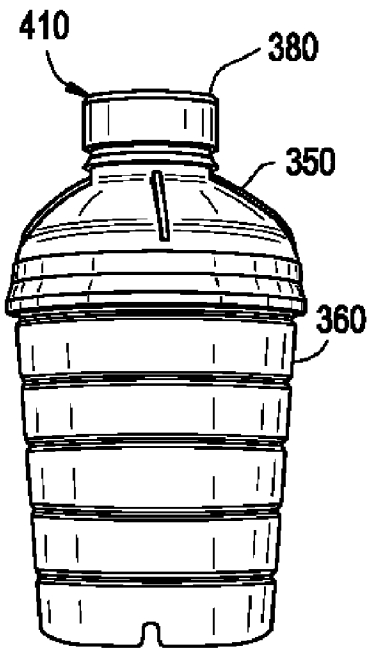
Figure 6A:
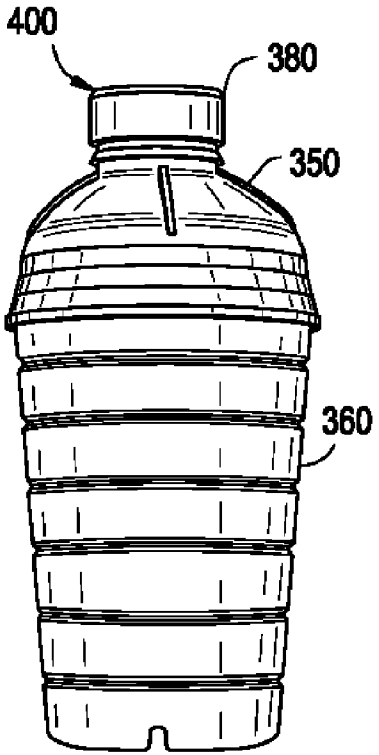

FIG. 6A shows the combination 400 similar in size to that shown in FIG. 3. In this example, the combination 400 may be in the form of about a 0.675 milliliter bottle designed to hold about half a liter of a beverage. FIG. 6B shows a combination 410 that may be in the form of about a 0.52 liter bottle intended to hold about 0.4 milliliters of a beverage. FIG. 6C may show a combination 420 and may be in the form of about a 0.344 milliliter bottle intended to hold about 0.25 milliliters of a beverage. Any desired size or shape may be used herein.

Figure 7A:
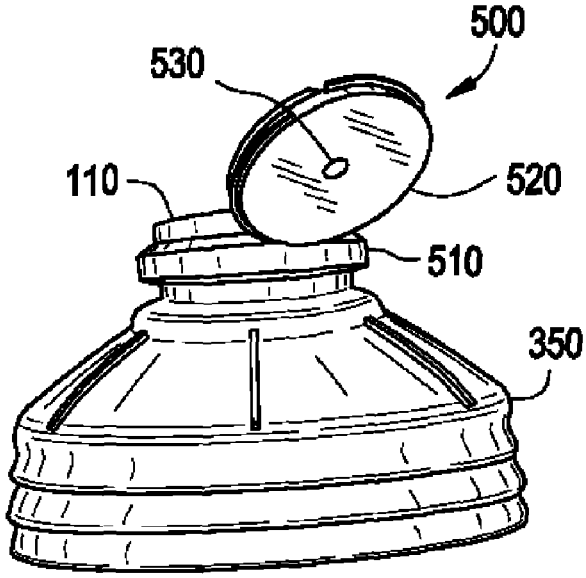
FIG. 7A is a perspective view of an embodiment of a closure.
Figure 7B:
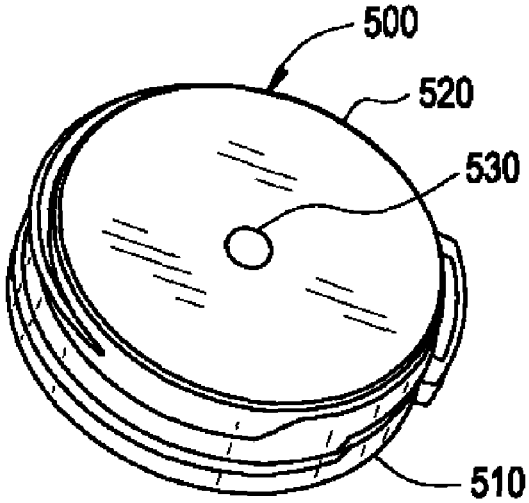
FIG. 7B is a further perspective view of the closure of FIG. 7A.
Figure 8A:
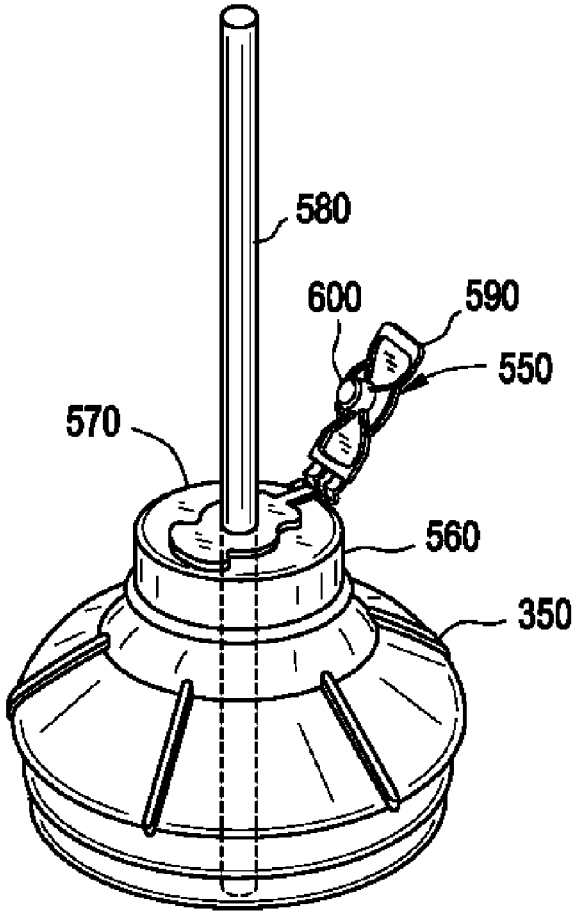
FIG. 8A is a perspective view of a further embodiment of a closure.
Figure 8B:
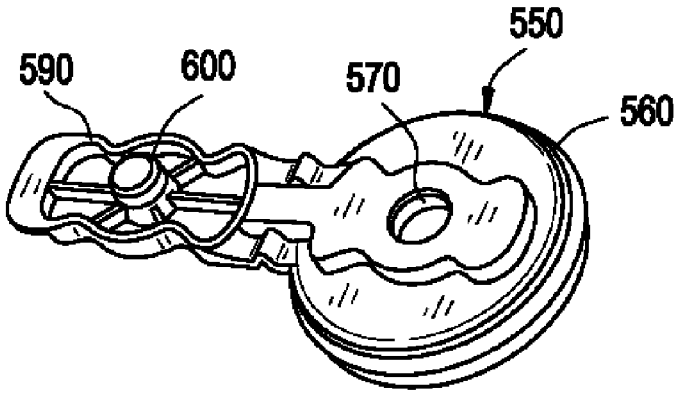
FIG. 8B is a further perspective view of the closure of FIG. 8A.
Figure 9:
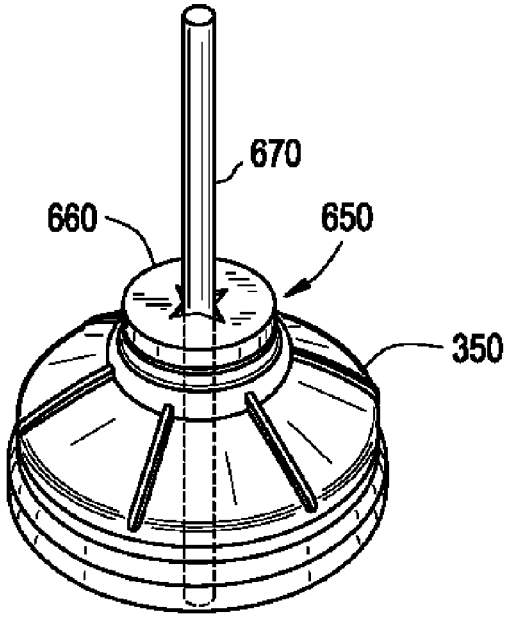
FIG. 9 is a perspective view of a further embodiment of a closure.

FIGS. 7 through 9 show various types of closures 380 that may be used with the lid 350 described herein. FIG. 7 shows a flip-top closure 500. The flip-top closure 500 includes a base rim 510 that attaches to the mouth 110 of the lid 350. A cap 520 may be attached to the base rim 510 by a hinge or other type of folding device so as to enclose the mouth 110 of the lid 350. The cap 520 may have a center aperture 530 for the placement of a drinking straw therein. The center aperture 530 may be enclosed and substantially watertight until broken by the straw. The flip-top closure 500 thus may operate by opening the cap 520 or by penetrating the center aperture 530 of the cap 520.

FIG. 8 shows a further type of a flip-top closure 550. The flip-top closure 550 may include a cap 560 that may be attached to the mouth 110 of the lid 350. The cap 560 may have a center aperture 570 that may be sized to accommodate a typical drinking straw 580. The cap 560 may be snapped on to the mouth 110 or may be twisted on via the threads 120. The cap 560 may be enclosed by a lid 590 with a center protrusion 600. Positioning the protrusion 600 within the aperture 570 results in a largely watertight seal. The lid 590 may be attached to the cap 560 by a hinge or the type of folding mechanism.

FIG. 9 shows a closure 650. The closure 650 may snap on to the mouth 110 of the lid 350. The closure 650 may have a number of slits 660 formed therein. The slits 660 may be largely star-shaped so as to provide an opening for the straw 670. The slits 660 then may flex back once the straw 670 is removed so as to limit the loss of carbonation through the closure 650. Any other type of closure design may be used herein.

Figure 10:
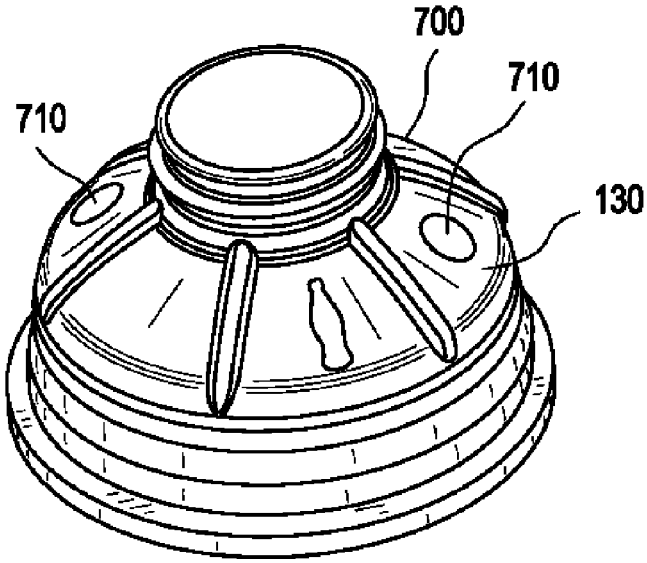
FIG. 10 is a perspective view of an alternative embodiment of a lid as is described herein.

FIG. 10 shows a further embodiment of a lid 700. The lid 700 may be similar to the lid 350 described above, but with the addition of one or more buttons 710. The buttons 710 are raised areas in the shoulder 130. The buttons 710 may be depressed to indicate a quality of the beverage therein. For example, depressing one button 710 may indicate a diet beverage while depressing the other button may indicate a caffeine free beverage.

It should be understood that the foregoing relates only to the exemplary embodiments of the present application and that numerous changes and modifications may be made herein without departing from the general spirit and scope of the invention as defined by the following claims and the equivalents thereof.

What is claimed is:

1. A bottle, comprising:

a cup;

the cup comprising a plurality of first conical sections extending downwardly and outwardly;

the plurality of first conical sections comprising a plurality of spaced apart first ledges extending inwardly;

a removable top lid;

the lid comprising a plurality of second conical sections extending downwardly and outwardly;

the plurality of second conical sections comprising a plurality of spaced apart second ledges extending inwardly;

wherein the plurality of first conical sections mate with the plurality of second conical sections; and a closure positioned on the lid.

2. The bottle of claim 1, further comprising a polylactide acid material.

3. The bottle of claim 1, wherein the plurality of first conical sections comprises a first lower section, wherein the plurality of second conical sections comprises a second lower section, and wherein the first lower section accommodates the second lower section.

4. The bottle of claim 1, wherein the closure comprises a flip top closure.

5. The bottle of claim 1, wherein the closure comprises a plurality of slits positioned therein.

6. The bottle of claim 1, wherein the lid comprises a plurality of buttons.

7. The bottle of claim 1, further comprising a substantially clear material.

8. The bottle of claim 1, wherein the plurality of first conical sections comprises a first upper section with a first ledge extending therefrom.

9. The bottle of claim 8, wherein the plurality of second conical sections comprises a second upper section with a second ledge extending therefrom.

10. The bottle of claim 9, wherein in the first ledge engages the second ledge.

* * * * *